US007624895B2

(12) United States Patent
Haskayne

(10) Patent No.: US 7,624,895 B2
(45) Date of Patent: Dec. 1, 2009

(54) TOWER DISPENSER

(75) Inventor: Paul Haskayne, Middlewich (GB)

(73) Assignee: Lancer Partnership, Ltd., San Antonio, TX (US)

( * ) Notice: Subject to any disclaimer, the term of this patent is extended or adjusted under 35 U.S.C. 154(b) by 476 days.

(21) Appl. No.: 11/060,229

(22) Filed: Feb. 17, 2005

(65) Prior Publication Data

US 2006/0180610 A1 Aug. 17, 2006

(51) Int. Cl.
*B67D 5/56* (2006.01)

(52) U.S. Cl. ..... 222/129.1; 222/132; 222/135; 222/145.1

(58) Field of Classification Search ... 222/129.1–129.4, 222/132, 135, 145.1, 145.5–145.8
See application file for complete search history.

(56) References Cited

U.S. PATENT DOCUMENTS 4,059,181 A * 11/1977 Greenfield et al. ..... 194/242
5,492,250 A * 2/1996 Sardynski ..... 222/108
5,842,603 A * 12/1998 Schroeder et al. ..... 222/23
5,960,997 A * 10/1999 Forsythe ..... 222/129.3
6,832,487 B1 * 12/2004 Baker ..... 62/115
7,044,335 B2 * 5/2006 Aguirre et al. ..... 222/129.1
2002/0056721 A1 * 5/2002 Phillips et al. ..... 222/1

* cited by examiner

*Primary Examiner*—J. Casimer Jacyna
(74) *Attorney, Agent, or Firm*—Christopher L. Makay

(57) ABSTRACT

A beverage dispenser includes a tower head disposed atop a tower, and at least one beverage syrup flow path having at least one control module disposed within the tower to regulate the flow of a beverage syrup through the flow path, thereby reducing the size requirements for the tower head. The beverage dispenser may further include additional flow paths to add variable products. The beverage dispenser further includes a control board including at least one input and output device disposed on a top of the beverage dispenser, such that an operator may easily interact with the control board to configure the beverage dispenser. The beverage dispenser may be utilized in a master/slave arrangement, wherein a slave beverage dispenser without a control panel is disposed adjacent to and in communication with the control board of the master beverage dispenser, such that the master beverage dispenser conducts all global and configuration operations.

32 Claims, 6 Drawing Sheets

TOWER DISPENSER

BACKGROUND OF THE INVENTION

1. Field of the Invention

The present invention relates to beverage dispensing and, more particularly, but not by way of limitation, to methods and an apparatus for dispensing beverages effectively with a reduced width beverage dispenser.

2. Description of the Related Art

In the beverage dispensing industry, counter top space continues to be a precious commodity. Store owners continuously face the problem of not having adequate counter top space to house all of the different types of product dispensing equipment and related supplies. Beverage dispenser manufacturers are continually pressed to provide smaller dispensers while increasing dispenser capabilities. Beverage dispensers with increased features typically include additional valves and additional flow controllers for additional product flow paths.

Existing beverage dispenser designs require a minimum width per nozzle or in the case of a multi flavor nozzle, a certain width per flow control module pair. As such, any increased number of flavors or dispensing valves in a beverage dispenser creates a compounding width dimension, as the flow control modules are typically in close proximity to the dispensing nozzle for easy servicing.

Further, the recent popularity and increased usage of non-carbonated beverages and ambient refreshments creates increased demands on remote towers, as more flow control devices must be utilized to control the flows of the added products. The situation if still further complicated by the addition of bonus flavors that are injected into a brand beverage, as the beverage dispenser likewise must accommodate and control the flow of the bonus flavorings.

Accordingly, an easily serviceable beverage dispenser able to provide increased capabilities without the increased width associated with standard beverage dispenser designs would be beneficial to beverage dispenser operators, beverage dispenser manufacturers, and beverage dispenser service agents.

SUMMARY OF THE INVENTION

In accordance with the present invention, a beverage dispenser includes a tower having a tower cavity and a tower head disposed atop the tower. The beverage dispenser further includes at least one beverage syrup flow path and at least one control module disposed within the tower to regulate the flows of a beverage syrup through the at least one flow path. In this arrangement, the beverage dispenser tower head size requirements are minimized, as fewer components are located within the tower head. In an alternative embodiment, the beverage dispenser may further include additional flow paths to provide the beverage dispenser with the capability to dispense uncarbonated diluents, carbonated diluents, ambient beverages, injected flavorings, and the like. One of ordinary skill in the art will recognize that control modules for the varying flow paths may be located within the tower to further reduce the envelope of the tower head of the beverage dispenser.

The tower head further includes a fully accessible cavity having a cover and an interface plate that opens for increased access into the cavity. Once opened, a crossbar may be removed to provide unlimited frontal and top access, such that any components disposed within the tower head may be readily accessible. The beverage dispenser further includes a control board including at least one input receptor and an output device disposed on a top of the beverage dispenser, such that an operator may easily interact with the control board to configure the beverage dispenser. In this embodiment, the control board is attached to a plate rotatably mounted to the cover, such that the control board is substantially vertical when the cover is open, and horizontal and beneath the cover when the cover is in a closed position. In this arrangement, the control board is usable by the operator from a front of the beverage dispenser.

In another embodiment, the beverage dispenser may be utilized in a master/slave arrangement, wherein a slave beverage dispenser without a control board is disposed adjacent to and in communication with the control board of the master beverage dispenser, such that the master beverage dispenser conducts all global operations, and configuration operations.

It is therefore an object of the present invention to provide a reduced width beverage dispenser having at least one control module disposed within a tower cavity.

It is a further object of the present invention to provide a beverage dispenser with a control board disposed at a top of the beverage dispenser, wherein an operator interacts with the control board from a front of the beverage dispenser.

It is still further an object of the present invention to provide a beverage dispenser with an increased accessibility to a cavity.

It is still yet further an object of the present invention to provide a beverage dispenser system including a master beverage dispense in communication with a slave beverage dispenser, wherein the master beverage dispenser conducts all global and configuration operations Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

Beverage dispensers are commonly known in the art as the devices that deliver on demand beverages to consumers. Historically, the beverage dispenser provided a mixing and dispensing point for a syrup concentrate and a carbonated diluent. In recent times, the term "beverage," as utilized in conjunction with the beverage dispenser, has been expanded to additionally refer to ambient drinks, plain waters, flavored waters, and bonus flavorings. The expansion of the term was necessary, as newer dispenser designs currently provide the capability to dispense the aforementioned types of beverages. The increased versatility of the beverage dispenser generally requires more components than older type dispensers. As such, beverage dispenser manufacturers are continually forced to devise new ways of putting more components into smaller packages. As one of ordinary skill in the art will recognize, most beverage dispensers provide flow paths for each type or flavor of product, as well as for any diluents, carbonated diluents, and bonus flavors. Each flow path still further includes a control module in communication with a control system; illustratively, a valve in communication with a processor, wherein the control module commences and ceases the product flow. Control module accordingly in this disclosure refers to a control module for a diluent flow path, a beverage syrup flow path, a bonus flavor flow path, or the like. While there may be slight differences between the locations of the control modules within a tower dispenser of the preferred embodiments, the locations of the control modules are interchangeable with each other. At least one embodiment of this disclosure relates to the relocation of control modules to locations not ordinarily utilized in typical beverage dispensers, illustratively, a tower portion.

Figure 1:
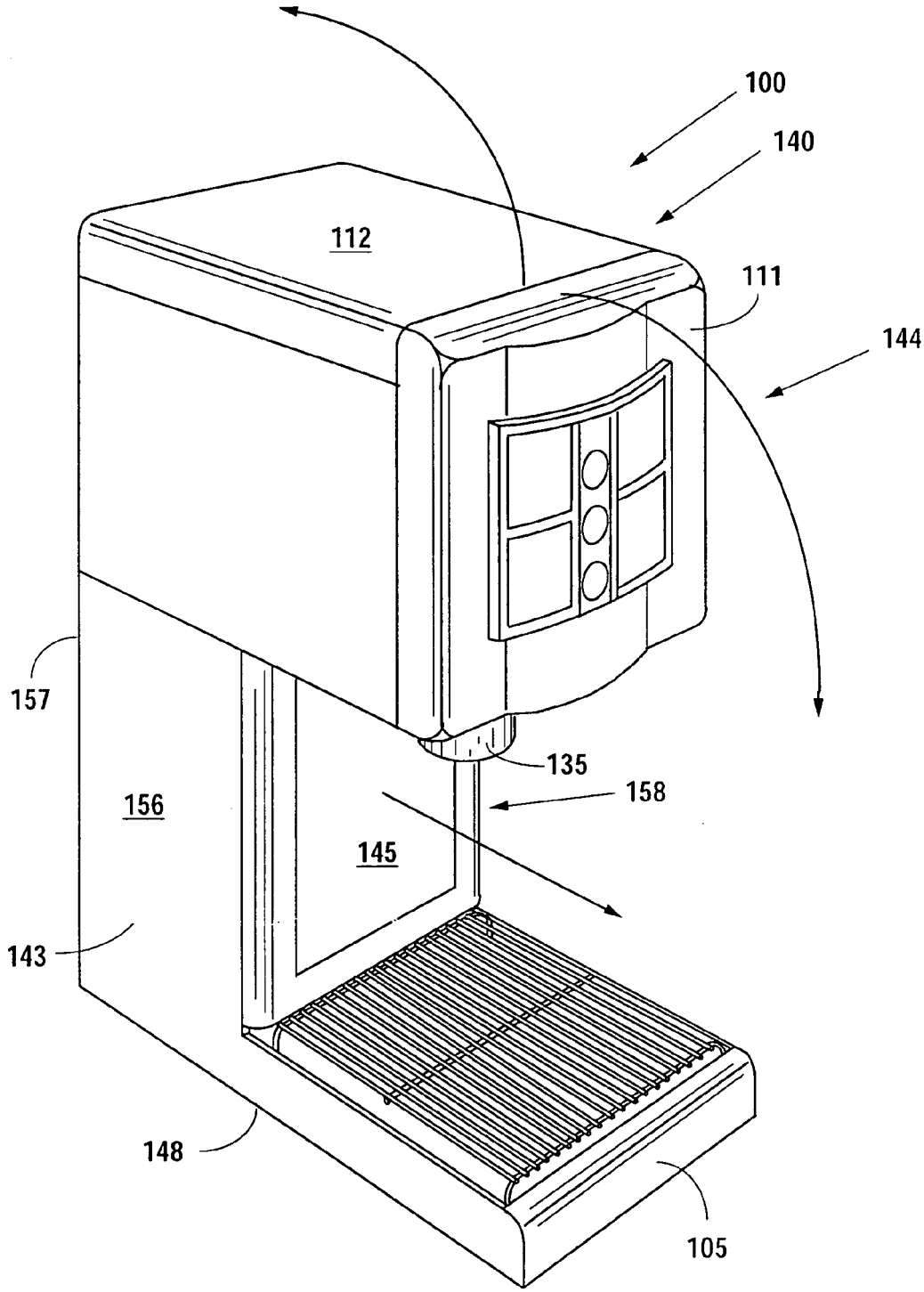
FIG. 1 provides a perspective view of a beverage dispenser according to a first embodiment.
Figure 2:
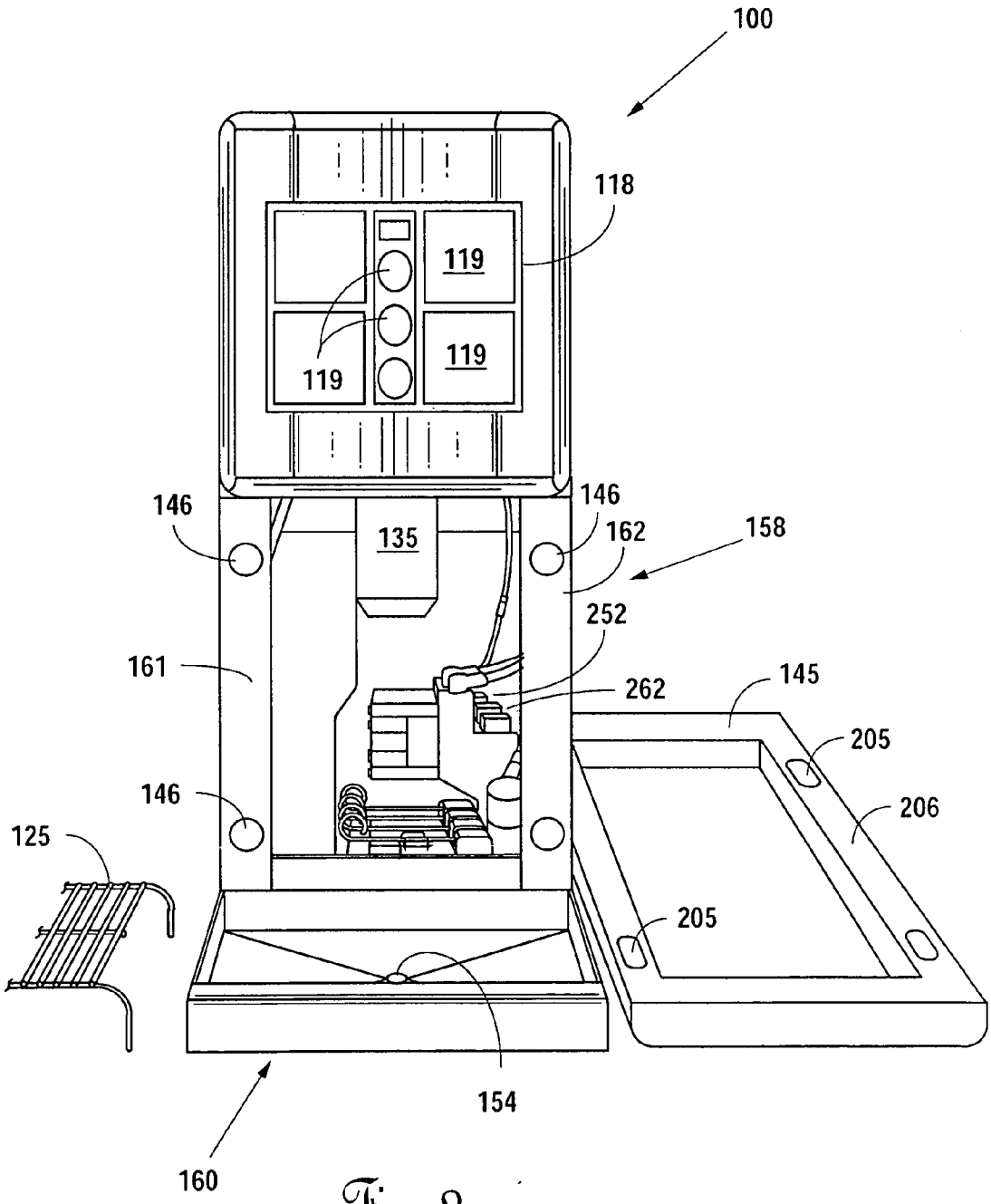
FIG. 2 provides a front view of the beverage dispenser with a splash plate removed according to the first embodiment.

As shown in FIGS. 1-3, a beverage dispenser 100 includes a housing 140, an interface panel 111, a nozzle 135, a splash plate 145, and a cover 112. The housing 140 may include a tower 143 and a tower head 144. The tower 143 is rectangular in shape, and includes a first wall 156, a second wall 157, and a third wall 158 at substantially right angles, such that the tower walls 156, 157, and 158 create a tower cavity 160. The tower 143 further includes a first flange 161 disposed adjacent to the first wall 156, and a second flange 162 adjacent to the third wall 158 along a front 105 of the beverage dispenser 100. The first flange 161 and the second flange 162 further enclose the tower cavity 160. In this first embodiment, the first and second flanges 161 and 162 extend the full length of the tower 143, and have a width suitable for housing restraint features 146 for the splash plate 145. In this configuration, the tower cavity 160 is accessible from the front 105 of the beverage dispenser 100. Access to the tower cavity 160 from the front 105 of the beverage dispenser 100 is advantageous to operators, as the beverage dispensers are typically situated adjacent to one another on a counter top. While this first embodiment is shown with a rectangular tower 143, it should be clear to one of ordinary skill in the art that a tower 143 may be of virtually any shape or configuration.

The tower 143 may further include a drip tray 120 near a first end 148 of the tower 143, and in this first embodiment, the drip tray 120 is integral to the tower 143. The drip tray 120 may further include a cup rest 125, whereby the cup rest 125 supports cups that are going to be filled at the beverage dispenser 100. The drip tray 120 may include a drain 154 to evacuate fluids that end up within the drip tray 120. The first end 148 of the tower 143 is planar, such that the tower 143 may rest on a flat surface such as a counter top.

The tower head 144 is an enclosure having a first wall 165, a second wall 166, a third wall 167, a first flange 168, and a second flange 169. The first wall 165 is joined to the second wall 166 at substantially a ninety-degree angle, and the second wall 166 is mounted to the third wall 167 at substantially a ninety-degree angle, such that the walls form a cavity 170. The size of the tower head 144 is complementary to the width of the tower 143. The first flange 168 and the second flange 169 of the tower head 144 are disposed along the front 105 of the beverage dispenser 100, and folded toward the cavity 170 at approximately ninety-degree angles to further enclose the cavity 170. A first end 151 of the tower head 144 includes a floor 172 that closes out a lower portion of the tower head 144. The floor 172 may include a nozzle port 174 for accepting the dispensing nozzle 135. While the floor 172 is shown with a single nozzle port 174, one of ordinary skill in the art will recognize that multiple nozzles may be utilized in a beverage dispenser. While the tower head 144 has been described as a rectangular section, it should be clear to one of ordinary skill in the art that the tower head 144 may be any form or shape capable of having a cavity.

A second end 152 of the tower head 144 may include a first flange 176 attached to the first wall 165, and a second flange 177 attached to the third wall 167. The first flange 176 and the second flange 177 are directed inward toward the cavity 170, and are of a width suitable for supporting a roller, illustratively one half of an inch. The first flange 176 and the second flange 177 may further include an engagement slot 178 for accepting reinforcement components. The housing 110 further includes a crossbar 180. In this first embodiment, the crossbar 180 extends from the first wall 165 to the third wall 167 to provide lateral support to the walls 165 and 167 of the tower head 144. The cross bar 180 is of a sheetmetal construction, preferably stainless steel, and includes a first side 181 and a second side 182 at substantially a ninety degree angle. The first side 181 of the crossbar 180 may further include restraint mechanisms 184. Each end of the crossbar 180 may include a tab 183 for engagement purposes.

On assembly of the housing 140, the tower head 144 is positioned on top of the tower 143, such that the first end 151 of the tower head 144 is adjacent to a second end 149 of the tower 143. The tower head 144 is further positioned such that the cavity 170 exposed between the first and second flanges 168 and 169 faces the same direction as the exposed portion of the tower cavity 160, illustratively the front 105 of the beverage dispenser 100. The tower head 144 further includes a first hinge 187. The first hinge 187 includes a first leg, a second leg, and an axis. The first leg of the first hinge 187 is attached along an uppermost edge of the second wall 166.

The cover 112 closes out a top portion of the cavity 170. In this first embodiment, the cover 112 is formed from sheet metal, and includes a planar surface 191 having a first flange 192, a second flange 193, a third flange 194, and a fourth flange 195. The flanges 192, 193, 194, and 195 extend in the same direction and are joined to form an enclosure. In this embodiment, the fourth flange 195 is located nearest the second wall 166 of the tower head 144, and is further attached to the second leg of the first hinge 187, such that the cover 112 may rotate downward about the axis of the first hinge 187 to close out the cavity 170 or upward to access the cavity 170. In this arrangement, the cover 112 lifts away from the front 105 of the beverage dispenser 100, such that an operator may view into the cavity 170. The second flange 193 and the third flange 194 further include at least one pin aperture 196, and at least one pin aperture 197, respectively. The pin apertures 196 and 197 are disposed on an inner lip of the first flange 192 and the third flange 194, at a point substantially central along the length of the first and third flanges 192 and 194.

The beverage dispenser 100 still further includes a board mounting plate 214 having a first end 219, a second end 220, a first leg 215, a second leg 216, a first mount 217 and a second mount 218. In this first embodiment, the board mounting plate 214 is complementary to a width between the first and second flanges 176 and 177 of the tower head 144. The board mounting plate 214 may be constructed from virtually any material suitable for rigid support, preferably non conductive materials, however, one of ordinary skill in the art will recognize that metal such as stainless steel may be utilized if electrically isolated from any powered components. The first leg 215 and the second leg 216 may be any form of screw, pin, or roller secured to the extreme ends of the first end 219 such that they protrude from the board mounting plate 214. The first mount 217 and the second mount 218 may be any type of screw or removable pin connection, such that the board mounting plate 214 may be attached to the cover 112. In this first embodiment, the first mount 217 of the board mounting plate 214 passes through the pin aperture 196, and the second mount 218 passes through the pin aperture 197, such that the board mounting plate 214 is rotatably coupled to the cover 112. In this configuration, the first and second legs 215 and 216 of the board mounting plate 214 rest on top of the first and second flanges 176 and 177 of the tower head 144. Once pinned, the board mounting plate 214 translates with the cover 112 when the cover 112 moves from the open position to the closed position. Accordingly, in the raised position the board mounting plate 214 is slightly tilted away from the front 105 of the beverage dispenser 100, illustratively twenty to thirty degrees, such that an operator may easily view the board mounting plate 214. In the closed position the board mounting plate 214 is lies in a substantially horizontal position beneath the cover 112. This arrangement creates an easily accessible board mounting plate 214.

The interface panel 111 provides a means for a user to interact with the beverage dispenser 100. The interface panel 111 includes a first end 201, a second end 202, and attraction plates 203 disposed on the second end 202 of the interface panel 111. The housing 110 further includes a second hinge 188 having a first leg, a second leg, and an axis therebetween. The first leg of the second hinge 188 is attached to an edge of the floor 172 that is exposed between the first flange 168 and the second flange 169 on the tower head 144. The first end 201 of the interface panel 111 is attached to the second leg of the second hinge 188, such that the interface panel 111 may pivot about the axis of the second hinge 188. In a lowered position, the interface panel 111 provides access to the cavity 170 from the front 105 of the beverage dispenser 100. In a closed position, the attraction plates 203 move the second end 202 of the interface panel 111 toward the restraint mechanisms 184. In this first embodiment, the restraint mechanisms 184 are magnets secured to the crossbar 180, and the attraction plates 203 are of a magnetic construction, such that they force the interface panel 111 toward the tower head 144 when within range of the magnetic field, thereby closing out the cavity 170. The ability to readily access and close out the cavity 170 from the front of the beverage dispenser 100 provides an added benefit to operators of the beverage dispenser 100, as they can easily access components disposed within the cavity 170. The interface panel 111 may further be complementary in shape to a front 212 of the tower head 144. The second hinge 188 may be secured to the attached components using any suitable means, including screws, welding, or the like.

The splash plate 145 may be any structure suitable for redirecting fluids moving toward the tower cavity 160. The splash plate 145 may be constructed from any suitable material that is impervious to beverage concentrates, carbonated waters, and the like, for example, stainless steel. The splash plate 145 is complementary in size to the exposed portion of the tower cavity 160, such that it closes out the tower cavity 160. In this first embodiment, the splash plate 145 includes at least one attraction plate 205 mounted to an inner surface 206 of the splash plate 145. The attraction plates 205 are complementary in location to the restraint features 146 located on the flanges 161 and 162 of the tower 143. When the splash plate 145 is placed onto the tower 143, the restraint features 146 pull the attraction plates 205 against the restraint features 146, thereby holding the splash plate 145 in a mounted position. In the mounted position, the splash plate 145 redirects misdirected fluids to the drip tray 120 for at least a partial containment. The use of an easily removable and replaceable restraint scheme provides the operator with the ability to quickly access components disposed behind the splash plate 145.

The beverage dispenser 100 utilizes a multi-flavor nozzle 135 such as that disclosed in U.S. Pat. Nos. 6,098,842; 6,047,859; and 6,345,729, the disclosures of which are hereby incorporated by reference, to eliminate the width requirement associated with conventional single flavor nozzles. The nozzle 135 is disposed in the nozzle port 174 located in the floor 172 of the tower head 144. The nozzle 135 is elevated above the drip tray 120 and the cup rest 125, such that there is clearance for a cup to be placed beneath the nozzle 135, and errant fluids will land within the confines of the drip tray 120.

In this first embodiment, the beverage dispenser 100 is an island dispenser for a larger dispensing system, and accordingly, as one of ordinary skill in the art will recognize, any syrups and diluents must be conditioned by a backroom or remote device (not shown). The dispensing system may further include a recirculation pump (also remote). In this arrangement, all product lines from the beverage dispenser 100 pass through the counter to mate with lines from the back room system. In this first embodiment, the beverage dispenser 100 includes flow paths for four syrup brand circuits, two diluent circuits, and two injected flavor circuits. For illustrative purposes, only one of the brand and one of the injected flavor circuits will be discussed herein.

A first brand flow path commences exterior to the tower 143, such that syrup connections to the beverage dispenser 100 may be made beneath a counter when the beverage dispenser 100 is in an installed position. The brand connection line passes through the tower 143 to gain access to the cavity 170, where it mates to a first control module 226. The first brand flow path then moves to a delivery tube. The delivery tube then leads to a first syrup port on the nozzle 135. In this first embodiment, the first control module 226 is a volumetric syrup module. As one of ordinary skill in the art will recognize, the volumetric control module may be replaced with manual flow controls to reduce costs.

A first diluent circuit also commences exterior to the tower 143. A first diluent line passes through the tower cavity 160 and enters the tower head 144 to mate with a second control module 233 that is disposed within the cavity 170. The first diluent circuit continues to a first diluent delivery tube. The first diluent delivery tube leads to a first port of a tee. A second port of the tee is then coupled to a second diluent feed tube that mates to the diluent port of the nozzle 135. In this first embodiment, the second control module 233 is a volumetric control module that is routinely utilized in the industry. As one of ordinary skill in the art will recognize, a volumetric second control module 233 may be replaced with manual flow controls to reduce costs.

A second diluent circuit includes a second diluent line, a third control module 252, a second diluent delivery tube, the tee, and the diluent feed tube. A first end of the second diluent line protrudes from the first end 148 of the tower 143 for mating to a suitable supply. The second diluent line leads to the third control module 252 that is disposed within the tower cavity 160. The second diluent circuit continues through the second diluent delivery tube that attaches to a third port of the tee. The second diluent circuit continues through to the second port of the tee, and through the diluent feed tube to the diluent port of the nozzle 135. In this first embodiment, the second diluent circuit carries plain water, however one of ordinary skill in the art will recognize that virtually any suitable diluent may be utilized within the confines of the second diluent circuit, including carbonated diluent, plain water, and the like. The placement of the third control module 252 into the tower cavity 160 reduces the width associated with having additional control modules in the cavity 170, thereby providing increased capabilities within a smaller envelope.

A first flavor injection circuit commences with a first flavor line protruding from the tower 143 in similar fashion to the previously described lines, and connecting to a fourth control module 262. The first flavor injection circuit continues through the fourth control module 262 to a flavor delivery tube. The flavor delivery tube then connects to a first flavor port of the nozzle 135. In this first embodiment, the fourth control module 262 is a flow control valve, and is located within the tower cavity 160. The placement of the fourth control module 262 into the tower cavity 160 further reduces the volume and width required in standard dispenser designs with equivalent dispensing options.

The beverage dispenser 100 further includes a control system 270 to regulate the product flows of the beverage dispenser 100. The control system 270 is of the type that utilizes a valve control module 271 to control the direct dispense related operations. The control system 270 further includes a control board 272 having a controller 273, an output device 274, and input receptors 275. In this first embodiment, the output device 274 is a lead crystal display panel that provides feedback to an operator. The input receptors 275 are disposed on the same side of the control board 272 as the output device 274. In this first embodiment, the input receptors 275 are buttons. The control board 272 further includes multiple communication ports, illustratively a first communication port 284, a second communication port 285, a third communication port 286, and a fourth communication port 287.

In this first embodiment, the control board 272 is mounted to the board mounting plate 214, such that the output device 274 is readable from the front 105 of the beverage dispenser 100 when the cover 112 is in a raised position. The placement of the control board 272 onto the board mounting plate 214 allows the operator to quickly access the control board 272 by raising the cover 112 to the raised position. Once the control board 272 has been accessed, the operator may utilize the input receptors 275 and output device 274 during setup and/or diagnosis of problems. The control system 270 further includes a power harness 279, a communication harness 278, and a valve wiring harness 277. The power harness 279 provides power to the control board 272. The communication harness 278 connects to the first communication port 284, and provides a path for communication between the valve control module 271 and the controller 273 disposed on the control board 272. The valve wiring harness 277 transmits signals from the valve control module 271 to the individual control modules 226, 233, 252, and 262 disposed in the fluid flow paths, thereby commencing and ceasing the flows associated with a selected dispense.

The valve control module 271 is disposed within the interface panel 111 of the beverage dispenser 100. The valve control module 271 is of the type that provides a backlit touch sensitive user interface 118 that is configurable to operate and dispense virtually any combination of zones 119 that represent four brands of concentrate, two types of diluent, and two bonus flavors, as described in U.S. patent application Ser. No. 10/677,854, the disclosure of which is hereby incorporated by reference. In this configuration, the valve control module 271 controls the user interface 118 for product selection and dispensing. As such, when a user touches a zone 119 of the user interface 118 of the valve control module 271, a particular beverage associated with the zone 119 is dispensed. A user is further able to select a bonus flavor with the brand selection, or a plain water dispense instead of a brand selection.

In the assembled form, the beverage dispenser 100 provides a reduced footprint dispenser suitable for use on a counter top. The placement of at least one control module 226, 233, 252 or 262 into the tower 143 portion of the beverage dispenser 100 clearly reduces the number of components that must be placed in the cavity 170 for flow control, as well as the volume of the beverage dispenser 100. While this embodiment has been shown with the second control module 252 and fourth control module 262 disposed within the tower cavity 160, it should be clear to one of ordinary skill in the art that the control modules 226, 233, 252 and 262 from any of the flow paths may be placed within the tower cavity 160, thereby further reducing the size and volume requirements of the beverage dispenser 100. It should further be noted that any combination of the control modules 226, 233, 252, or 262 may be placed within the tower cavity 160, illustratively, one diluent control module in combination with one syrup control module, all diluent control modules, or the like.

The use of magnets 146 on the splash plate 145 provides the ability to easily access the tower cavity 160 to service any control modules 226, 233, 252 or 262 that have placed into the tower cavity 160. Components located within the cavity 170 are also easily accessible by lowering the interface panel 111. The use of magnets in restraining the interface panel 111 provides frontal access to the components disposed within the cavity 170. Raising the cover 112 to an open position provides top access to the cavity 170. With the cover 112 and the interface panel 111 opened, an operator may remove the crossbar 180 to gain total access from a front 105 to rear direction.

The raising of the cover 112 further provides access to the control board 272, the output device 274 and the input receptors 275. In the raised position, the operator may interact with the control board 272 to program the beverage dispenser 100. Illustratively, the operator may read the liquid crystal display and input selections into the input receptors 275. Once the beverage dispenser 100 has been configured, the operator may lower the cover 112 to close out the cavity 170.

In operation, the control board 272 conducts and directs the beverage dispenser operations including programming of the valve control module 271, and the valve control module 271 conducts the dispensing operations. As the beverage dispenser 100 is shorter than most counter dispensers, approximately between twenty and twenty one inches, operators are able to view over the beverage dispenser 100, or at the control board 272 when the cover 112 is in an open position. With the cover 112 in the closed position, the cover 112 protects the control board 272. With the interface panel 111 in the closed position, the valve control module 271 is accessible for use.

Figure 3A:
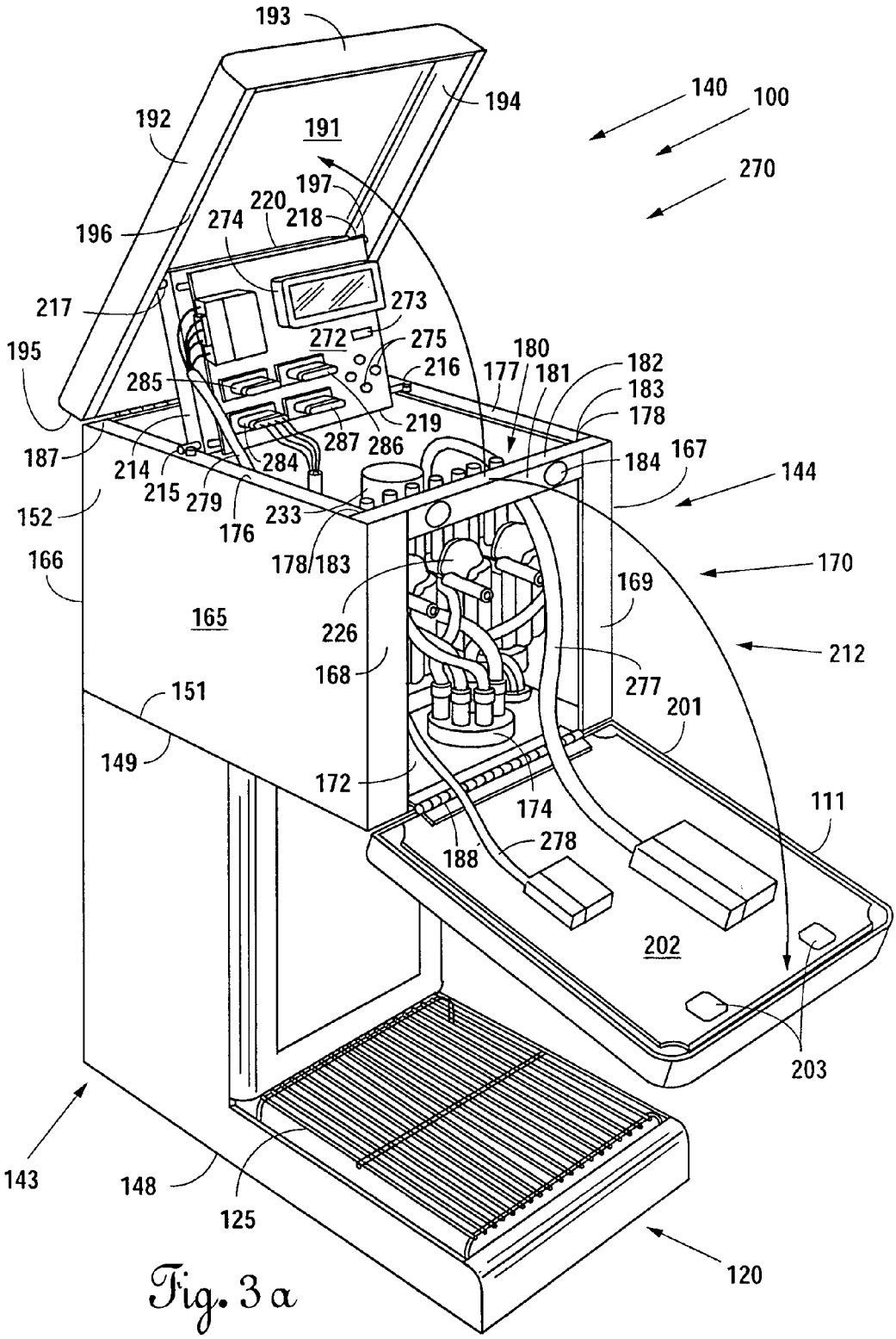
FIG. 3*a* provides a perspective view of the beverage dispenser with a cover in an open position, and an interface panel lowered according to the first embodiment.
Figure 3B:
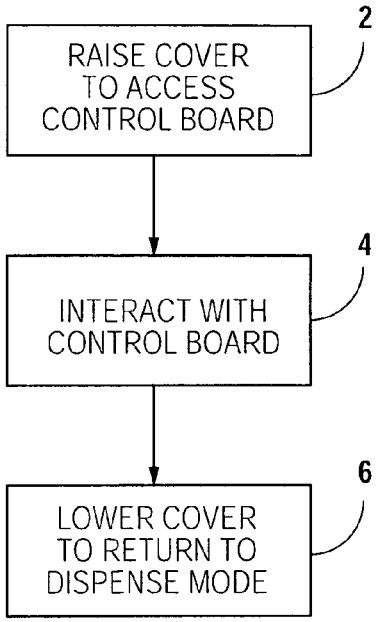
FIG. 3*b* provides a method flowchart for interacting with the control system when a cover is raised according to the first embodiment.

As shown in the method flowchart of FIG. 3*b*, an operator lifts the cover 112 to gain access to the control board 272, step 2. While the cover 112 moves to the raised position, the upper end of the control board 272 moves with the cover 112 to the raised angled position. In this position, the control board 272 is within the sight and reach of the operator. The operator may then conduct any necessary configuration operations including reading the output device 274 and providing input through the input receptors 275, step 4. Once the configuration changes have been accomplished, the operator may then lower the cover 112 and return to dispensing product, step 6. Once the beverage dispenser 100 is properly configured, an operator is able to secure a beverage from the beverage dispenser 100 by placing a cup below the nozzle 135, touching a particular zone 119, and retrieving the cup.

Figure 3D:
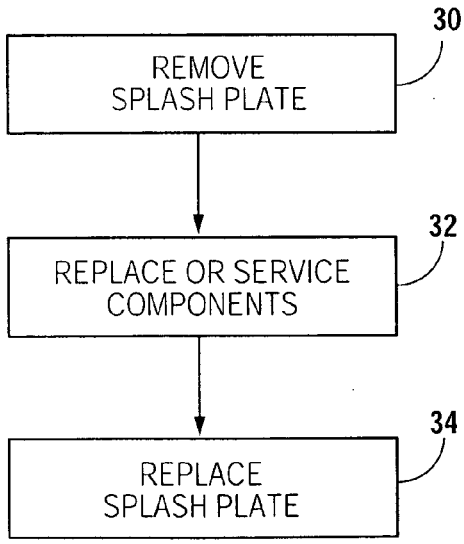
FIG. 3*d* provides a method flowchart for servicing components disposed within a tower cavity according to the first embodiment.
Figure 3C:
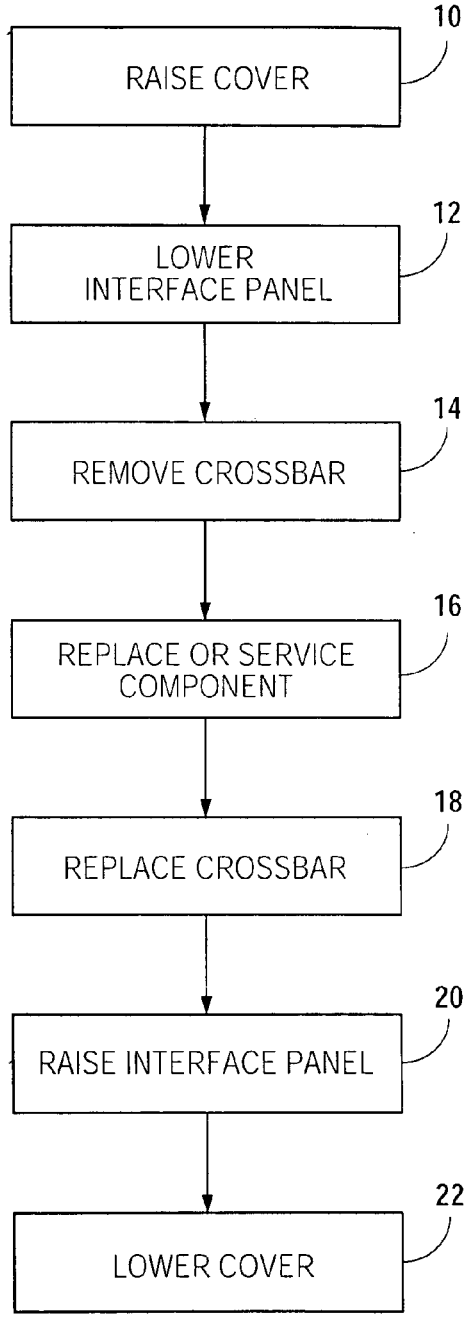
FIG. 3*c* provides a method flowchart for servicing components housed in a cavity of the beverage dispenser according to the first embodiment.

In this configuration, the beverage dispenser 100 is easily serviceable, as shown in the method flowchart of FIG. 3*c*. The process commences with step 10, wherein the cover is raised to gain access to a top portion of the cavity 170. The operator then lowers the interface panel 111 to gain access to the cavity 170 from the front 105 of the beverage dispenser 100, step 12. The operator may then remove the crossbar 180 as shown in step 14 to ease access to all components housed in the cavity 170. With the front and top sections of the cavity 170 now exposed, the operator may service or replace any malfunctioning components, step 16. Once the servicing of the components is completed, the operator may then reinstall the crossbar 180 to reinforce the tower head 144, as shown in step 18. Step 20 provides for raising the interface panel 111 to close out the front of the cavity 170, and step 22 provides for lowering the cover 112 to close the upper portion of the cavity 170.

Servicing of components disposed within the tower cavity 160 may be accomplished by the method provided in FIG. 3*d*. The process commences with step 30, wherein the operator removes the splash plate 145 to gain access to the tower cavity 160. The use of magnets as the restraint features 146 in the securing of the splash plate 145 to the tower 143 provides an easily removable and replaceable access solution. Step 32 provides for replacing or servicing any failed components, and step 34 provides for replacing the splash plate 145 to close out the tower cavity 160.

Figure 4:
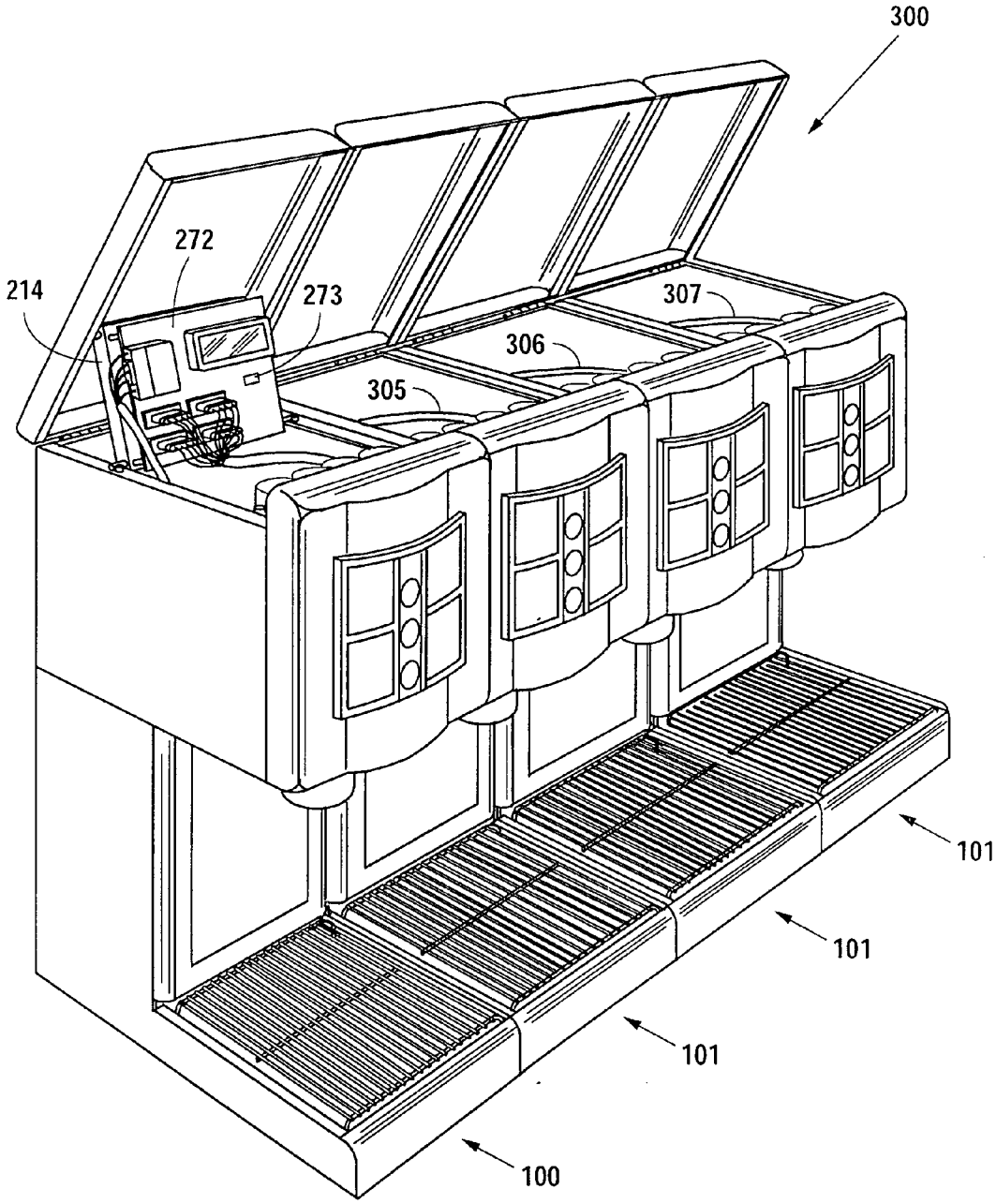
FIG. 4 provides a perspective view of a second embodiment including slave dispensers coupled to a master dispenser.
Figure 5:
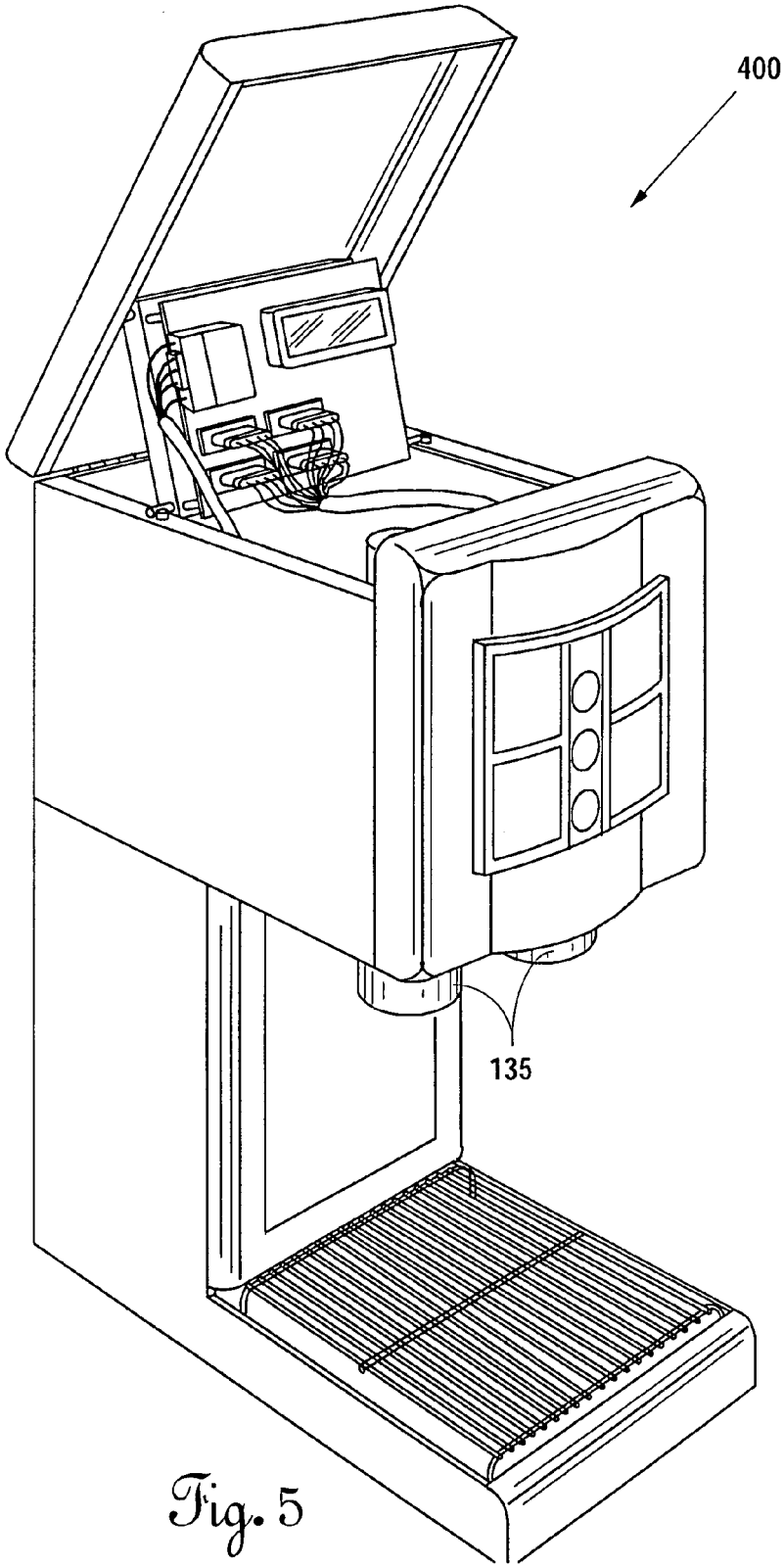
FIG. 5 provides a perspective view of a beverage dispenser including two dispensing nozzles according to a third embodiment.

In a second embodiment, the beverage dispenser 100 is utilized as a master in a master/slave beverage dispenser setup, and accordingly, like parts have been identified with like numerals. As shown in FIG. 4, at least one beverage dispenser 101, of virtually identical construction to the beverage dispenser 100, may be placed adjacent to the beverage dispenser 100 to form a beverage dispenser 300. The beverage dispenser 101 is identical to the beverage dispenser 100, except that the beverage dispensers 101 do not include a control board 272 or the board mounting plate 214. In this configuration, the beverage dispensers 101 also include an extended control harness 305 that connects to a next available communication port, illustratively the second communication port 285 on the control board 272 of the beverage dispenser 100. Accordingly, a third beverage dispenser 101 including an extended communication harness 306 connects to the third communication port 286 on the control board 272. Once the desired slave beverage dispensers 101 are connected, the controller 273 of the beverage dispenser 100 may conduct any operations other than dispensing routines for the master and the slave beverage dispensers, 100 and 101 respectively. The controller 273 may then also conduct global lighting routines between the master and slave beverage dispensers 100 and 101. Accordingly, the beverage dispenser 300 is modular, such that virtually any number of slave beverage dispensers 101 may be utilized if a communication port is available on the control board 272.

In a third embodiment, the beverage dispensers 100 and 300 of the first and second embodiments may be modified to further include a second beverage nozzle, thereby providing simultaneous dispensing capability. In this third embodiment, the beverage dispensers 100 and 300 are virtually identical in form, and accordingly, like parts have been numbered with like numerals. A beverage dispenser 400 is identical to the beverage dispenser 100, except that the beverage dispenser 400 includes an additional multi-flavor beverage dispensing nozzle 135 to provide dual dispensing points. One of ordinary skill in the art will recognize that various modifications must be made to a beverage dispenser 100 when moving from a single dispense point to dual dispense points, and that dual dispense points may provide an additional level of flexibility in the beverage dispenser 400. One of ordinary skill in the art will further recognize that the advantages and methods associated with the first and second embodiments are not hindered by the addition of a second dispense point, and that a beverage dispenser 400 having dual dispense points may be utilized in place of the beverage dispenser 100, as well as the beverage dispensers 101.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

I claim:

1. A beverage dispenser, comprising:

a housing including an accessible area on a top portion;

at least one beverage dispensing flow path disposed within the housing, the beverage dispensing flow path including a nozzle, wherein the at least one beverage dispensing flow path is in communication with a product source;

a control board disposed within the accessible area of the housing a cover hingedly coupled to the housing, wherein the cover closes out the top of the housing when in a lowered position, and further wherein the cover is raised to access the control board; and a plate having a first end and a second end, the first end rotatably coupled to the cover, and the second end translating along an upper edge of the housing, wherein the plate is substantially vertical when the cover is in the raised position, and substantially horizontal and beneath the cover when the cover is in the lowered position, and further wherein the control board is mounted to the plate, such that the control board is operable from a front of the beverage dispenser.

2. The beverage dispenser according to claim 1, wherein an operator may interact with the control board to configure parameters associated with dispensing of a beverage through the beverage dispensing nozzle.

3. The beverage dispenser according to claim 1, wherein the control board comprises a controller, an output device, and an input device, thereby allowing the controller to accept input and output information to the operator.

4. The beverage dispenser according to claim 3, wherein the output device is a liquid crystal display.

5. The beverage dispenser according to claim 4, wherein the input device is at least one pushbutton.

6. The beverage dispenser according to claim 3, wherein the control board is operable by an operator from the front of the beverage dispenser.

7. The beverage dispenser according to claim 4, wherein the liquid crystal display is readable from the front of the beverage dispenser.

8. A beverage dispenser, comprising:

a tower head comprised of a plurality of walls defining a tower head cavity;

a tower comprised of a plurality of walls defining a tower cavity, wherein the tower is disposed substantially completely underneath the tower head for supporting the tower head thereon;

a cross bar passing from a first top front corner to a second top front corner of the tower head such that the cross bar provides stability to the top front corners of the tower head, wherein the cross bar is removable to provide access along the front and top of the tower head cavity during servicing of the beverage dispenser;

at least one beverage dispensing nozzle coupled with the tower head;

at least one beverage syrup flow path disposed within the tower and the tower head, wherein the at least one beverage syrup flow path is coupled with the at least one beverage dispensing nozzle; and a control module disposed within the at least one beverage syrup flow path for commencing and ceasing the flow of beverage syrup through the at least one beverage flow path, wherein the control module is disposed within the tower head in the tower head cavity thereof;

at least one diluent flow path disposed within the tower and the tower head, wherein the at least one diluent flow path is coupled with the at least one beverage dispensing nozzle;

a control module disposed within the at least one diluent flow path for commencing and ceasing the flow of diluent through the at least one diluent flow path, wherein the control module is disposed within the tower in the tower cavity thereof; and a control board that operates the control modules to commence and cease the flow of beverage syrup and diluent through the at least one beverage syrup and diluent flow paths and to the beverage dispensing nozzle where the beverage syrup and diluent are combined to form a beverage.

9. The beverage dispenser according to claim 8, wherein the control board is disposed within the tower head in the tower head cavity thereof.

10. The beverage dispenser according to claim 8, further comprising:

at least one injected flavor flow path disposed within the tower and the tower head, wherein the at least one injected flavor flow path is coupled with the at least one beverage dispensing nozzle;

a control module disposed within the at least one injected flavor flow path for commencing and ceasing the flow of injected flavor through the at least one injected flavor flow path, wherein the control module is disposed within the tower head in the tower head cavity thereof; and the control board operates the control modules to commence and cease the flow of beverage syrup, diluent, and injected flavor through the at least one beverage syrup, diluent, and injected flavor flow paths and to the beverage dispensing nozzle where the beverage syrup, diluent, and injected flavor are combined to form a beverage.

11. The beverage dispenser according to claim 8, further comprising:

at least one injected flavor flow path disposed within the tower and the tower head, wherein the at least one injected flavor flow path is coupled with the at least one beverage dispensing nozzle;

a control module disposed within the at least one injected flavor flow path for commencing and ceasing the flow of injected flavor through the at least one injected flavor flow path, wherein the control module is disposed within the tower in the tower cavity thereof; and the control board operates the control modules to commence and cease the flow of beverage syrup, diluent, and injected flavor through the at least one beverage syrup, diluent, and injected flavor flow paths and to the beverage dispensing nozzle where the beverage syrup, diluent, and injected flavor are combined to form a beverage.

12. The beverage dispenser according to claim 8, further comprising a splash plate disposed at an exposed portion of the tower cavity, wherein the splash plate is removable for access to the tower cavity.

13. The beverage dispenser according to claim 8, further comprising:

a second beverage syrup flow path disposed within the tower and the tower head, wherein the second beverage syrup flow path is coupled with the at least one beverage dispensing nozzle; and a control module disposed within the second beverage syrup flow path for commencing and ceasing the flow of beverage syrup through the second beverage syrup flow path, wherein the control module is disposed within the tower head in the tower head cavity thereof.

14. The beverage dispenser according to claim 13, wherein the control board operates the control modules to commence and cease the flow of the second beverage syrup and diluent through the second beverage syrup and diluent flow paths and to the beverage dispensing nozzle where the second beverage syrup and diluent are combined to form a beverage.

15. The beverage dispenser according to claim 13, further comprising:

a second diluent flow path disposed within the tower and the tower head, wherein the second diluent flow path is coupled with the at least one beverage dispensing nozzle;

a control module disposed within the second diluent flow path for commencing and ceasing the flow of beverage through the second diluent flow path, wherein the control module is disposed within the tower in the tower cavity thereof; and the control board operates the control modules to commence and cease the flow of the second beverage syrup and second diluent through the second beverage syrup and second diluent flow paths and to the beverage dispensing nozzle where the second beverage syrup and second diluent are combined to form a beverage.

16. The beverage dispenser according to claim 8, further comprising:

a cover hingedly connected to the tower head, wherein an operator gains access to a top of the tower head cavity when the cover is in a raised position; and a panel hingedly coupled to a lower portion of the tower head, such that the panel closes out a front of the tower head cavity when in a raised position, wherein the panel may be rotated downward by an operator to gain access to the tower head cavity.

17. A beverage dispenser, comprising:

a housing;

at least one beverage dispensing nozzle coupled with the housing;

at least one beverage flow path disposed within the housing and coupled with the at least one beverage dispensing nozzle;

a control module disposed within the at least one beverage flow path for commencing and ceasing the flow of beverage through the at least one beverage flow path;

a panel hingedly coupled to the housing such that the panel closes out a front of the housing when in a raised position, wherein rotation of the panel downward provides access to components disposed within the housing;

a cover hingedly connected to the housing such that the panel closes out a top of the housing when in a lowered position, wherein rotation of the panel upward provides access to components disposed within the housing; and a cross bar passing from a first top front corner to a second top front corner of the housing to provide stability to the top front corners of the housing, wherein the cross bar is disposed behind the panel when the panel is in a raised position, further wherein, when the panel is rotated downward and the cross bar is exposed, the cross bar is removable to provide access along the front and top of the cavity during servicing of components disposed within the housing.

18. A beverage dispenser, comprising:

a tower head comprised of a plurality of walls defining a tower head cavity;

a tower comprised of a plurality of walls defining a tower cavity, wherein the tower is disposed substantially completely underneath the tower head for supporting the tower head thereon;

a cross bar passing from a first top front corner to a second top front corner of the tower head such that the cross bar provides stability to the top front corners of the tower head, wherein the cross bar is removable to provide access along the front and top of the tower head cavity during servicing of the beverage dispenser;

at least one beverage dispensing nozzle coupled with the tower head;

at least one beverage syrup flow path disposed within the tower and the tower head, wherein the at least one beverage syrup flow path is coupled with the at least one beverage dispensing nozzle; and a control module disposed within the at least one beverage syrup flow path for commencing and ceasing the flow of beverage syrup through the at least one beverage flow path, wherein the control module is disposed within the tower in the tower cavity thereof;

at least one diluent flow path disposed within the tower and the tower head, wherein the at least one diluent flow path is coupled with the at least one beverage dispensing nozzle;

a control module disposed within the at least one diluent flow path for commencing and ceasing the flow of diluent through the at least one diluent flow path, wherein the control module is disposed within the tower head in the tower head cavity thereof; and a control board that operates the control modules to commence and cease the flow of beverage syrup and diluent through the at least one beverage syrup and diluent flow paths and to the beverage dispensing nozzle where the beverage syrup and diluent are combined to form a beverage.

19. The beverage dispenser according to claim 18, wherein the control board is disposed within the tower head in the tower head cavity thereof.

20. The beverage dispenser according to claim 18, further comprising:

at least one injected flavor flow path disposed within the tower and the tower head, wherein the at least one injected flavor flow path is coupled with the at least one beverage dispensing nozzle;

a control module disposed within the at least one injected flavor flow path for commencing and ceasing the flow of injected flavor through the at least one injected flavor flow path, wherein the control module is disposed within the tower head in the tower head cavity thereof; and the control board operates the control modules to commence and cease the flow of beverage syrup, diluent, and injected flavor through the at least one beverage syrup, diluent, and injected flavor flow paths and to the beverage dispensing nozzle where the beverage syrup, diluent, and injected flavor are combined to form a beverage.

21. The beverage dispenser according to claim 18, further comprising:

at least one injected flavor flow path disposed within the tower and the tower head, wherein the at least one injected flavor flow path is coupled with the at least one beverage dispensing nozzle;

a control module disposed within the at least one injected flavor flow path for commencing and ceasing the flow of injected flavor through the at least one injected flavor flow path, wherein the control module is disposed within the tower in the tower cavity thereof; and the control board operates the control modules to commence and cease the flow of beverage syrup, diluent, and injected flavor through the at least one beverage syrup, diluent, and injected flavor flow paths and to the beverage dispensing nozzle where the beverage syrup, diluent, and injected flavor are combined to form a beverage.

22. The beverage dispenser according to claim 18, further comprising a splash plate disposed at an exposed portion of the tower cavity, wherein the splash plate is removable for access to the tower cavity.

23. The beverage dispenser according to claim 18, further comprising:

a second beverage syrup flow path disposed within the tower and the tower head, wherein the second beverage syrup flow path is coupled with the at least one beverage dispensing nozzle: and a control module disposed within the second beverage syrup flow path for commencing and ceasing the flow of beverage syrup through the second beverage syrup flow path, wherein the control module is disposed within the tower in the tower cavity thereof.

24. The beverage dispenser according to claim 23, wherein the control board operates the control modules to commence and cease the flow of the second beverage syrup and diluent through the second beverage syrup and diluent flow paths and to the beverage dispensing nozzle where the second beverage syrup and diluent are combined to form a beverage.

25. The beverage dispenser according to claim 23, further comprising:

a second diluent flow path disposed within the tower and the tower head, wherein the second diluent flow path is coupled with the at least one beverage dispensing nozzle;

a control module disposed within the second diluent flow path for commencing and ceasing the flow of beverage through the second diluent flow path, wherein the control module is disposed within the tower head in the tower head cavity thereof; and the control board operates the control modules to commence and cease the flow of the second beverage syrup and second diluent through the second beverage syrup and second diluent flow paths and to the beverage dispensing nozzle where the second beverage syrup and second diluent are combined to form a beverage.

26. The beverage dispenser according to claim 18, further comprising:

a cover hingedly connected to the tower head, wherein an operator gains access to a top of the tower head cavity when the cover is in a raised position; and a panel hingedly coupled to a lower portion of the tower head, such that the panel closes out a front of the tower head cavity when in a raised position, wherein the panel may be rotated downward by an operator to gain access to the tower head cavity.

27. A beverage dispenser, comprising:

a tower head comprised of a plurality of walls defining a tower head cavity;

a tower comprised of a plurality of walls defining a tower cavity, wherein the tower is disposed substantially completely underneath the tower head for supporting the tower head thereon;

a cross bar passing from a first top front corner to a second top front corner of the tower head such that the cross bar provides stability to the top front corners of the tower head, wherein the cross bar is removable to provide access along the front and top of the tower head cavity during servicing of the beverage dispenser;

at least one beverage dispensing nozzle coupled with the tower head;

at least one beverage syrup flow path disposed within the tower and the tower head, wherein the at least one beverage syrup flow path is coupled with the at least one beverage dispensing nozzle; and a control module disposed within the at least one beverage syrup flow path for commencing and ceasing the flow of beverage syrup through the at least one beverage flow path, wherein the control module is disposed within the tower in the tower cavity thereof;

at least one diluent flow path disposed within the tower and the tower head, wherein the at least one diluent flow path is coupled with the at least one beverage dispensing nozzle;

a control module disposed within the at least one diluent flow path for commencing and ceasing the flow of diluent through the at least one diluent flow path, wherein the control module is disposed within the tower in the tower head thereof; and a control board that operates the control modules to commence and cease the flow of beverage syrup and diluent through the at least one beverage syrup and diluent flow paths and to the beverage dispensing nozzle where the beverage syrup and diluent are combined to form a beverage.

28. The beverage dispenser according to claim 27, wherein the control board is disposed within the tower head in the tower head cavity thereof.

29. The beverage dispenser according to claim 27, further comprising:

at least one injected flavor flow path disposed within the tower and the tower head, wherein the at least one injected flavor flow path is coupled with the at least one beverage dispensing nozzle;

a control module disposed within the at least one injected flavor flow path for commencing and ceasing the flow of injected flavor through the at least one injected flavor flow path, wherein the control module is disposed within the tower head in the tower head cavity thereof; and the control board operates the control modules to commence and cease the flow of beverage syrup, diluent, and injected flavor through the at least one beverage syrup, diluent, and injected flavor flow paths and to the beverage dispensing nozzle where the beverage syrup, diluent, and injected flavor are combined to form a beverage.

30. The beverage dispenser according to claim 27, further comprising:

at least one injected flavor flow path disposed within the tower and the tower head, wherein the at least one injected flavor flow path is coupled with the at least one beverage dispensing nozzle;

a control module disposed within the at least one injected flavor flow path for commencing and ceasing the flow of injected flavor through the at least one injected flavor flow path, wherein the control module is disposed within the tower in the tower cavity thereof; and the control board operates the control modules to commence and cease the flow of beverage syrup, diluent, and injected flavor through the at least one beverage syrup, diluent, and injected flavor flow paths and to the beverage dispensing nozzle where the beverage syrup, diluent, and injected flavor are combined to form a beverage.

31. The beverage dispenser according to claim 27, further comprising a splash plate disposed at an exposed portion of the tower cavity, wherein the splash plate is removable for access to the tower cavity.

32. The beverage dispenser according to claim 27, further comprising:

a cover hingedly connected to the tower head, wherein an operator gains access to a top of the tower head cavity when the cover is in a raised position; and a panel hingedly coupled to a lower portion of the tower head, such that the panel closes out a front of the tower head cavity when in a raised position, wherein the panel may be rotated downward by an operator to gain access to the tower head cavity.

* * * * *